US005289669A

United States Patent [19]

Gerber et al.

[11] Patent Number: 5,289,669

[45] Date of Patent: Mar. 1, 1994

[54] CORELESS WINDER AND METHOD OF USE

[75] Inventors: H. Joseph Gerber, West Hartford; Claude LeBlond, Broadbrook; Kevin Williams, East Windsor; Alex Zusmanovich, South Windsor; A. Bruce Plumley, Meriden, all of Conn.

[73] Assignee: Gerber Garment Technologies, Inc., Tolland, Conn.

[21] Appl. No.: 681,887

[22] Filed: Apr. 8, 1991

[51] Int. Cl.[5] ..... B65B 51/04; B65B 61/06; B65B 63/04

[52] U.S. Cl. ..... 53/415; 53/416; 53/430; 53/435; 53/118; 53/520; 53/136.3; 53/138.2; 242/56 R; 242/57.1

[58] Field of Search ..... 242/56 R, 57.1; 156/184, 191; 83/614; 53/116, 118, 135.1, 136.3, 389.3, 389.4, 415, 416, 435, 520, 430, 138.2

[56] References Cited

U.S. PATENT DOCUMENTS

| | | | |
|---|---|---|---|
| 1,099,543 | 6/1914 | Fargo . | |
| 1,662,577 | 5/1926 | Johnson . | |
| 2,155,879 | 4/1939 | Washburn et al. . | |
| 2,357,976 | 9/1944 | Roesen . | |
| 2,839,256 | 6/1958 | Boyan et al. . | |
| 2,962,847 | 12/1960 | Tholle | 53/118 |
| 3,077,316 | 2/1963 | Wells et al. . | |
| 3,345,009 | 10/1967 | Rockstrom . | |
| 3,580,522 | 5/1971 | Hansen | 242/56 R |
| 3,712,553 | 1/1973 | Napor et al. | 242/56 R |
| 3,827,647 | 8/1974 | Jores et al. . | |
| 4,114,530 | 9/1978 | Miller . | |
| 4,155,516 | 5/1979 | Hughes et al. . | |
| 4,156,382 | 5/1979 | Baker | 83/614 X |
| 4,291,460 | 9/1981 | Stoehr | 53/118 X |
| 4,383,458 | 5/1983 | Kitai et al. | 83/614 X |
| 4,542,859 | 9/1985 | Gerstenberger . | |
| 4,573,644 | 3/1986 | Brown . | |
| 4,612,232 | 9/1986 | Obara et al. | 156/184 X |
| 4,683,022 | 7/1987 | Watanabe et al. | 242/56 R X |
| 4,790,491 | 12/1988 | Mundus et al. . | |
| 4,805,892 | 2/1989 | Calhoun | 242/57.1 X |
| 4,809,921 | 3/1989 | Dueck et al. . | |
| 4,838,497 | 6/1989 | Kramer et al. . | |
| 4,839,674 | 6/1989 | Hanagata et al. | 242/57.1 X |
| 4,844,369 | 7/1989 | Kanayachi | 242/56 R |
| 4,974,784 | 12/1990 | Steidle . | |
| 5,177,497 | 1/1993 | Calderon et al. . | |

FOREIGN PATENT DOCUMENTS

| | | |
|---|---|---|
| 100462A2 | 2/1984 | European Pat. Off. . |
| 0363917 | 4/1990 | European Pat. Off. . |
| 5917965 | 9/1954 | Fed. Rep. of Germany . |
| 52016940 | 10/1971 | Fed. Rep. of Germany . |
| 2248816 | 4/1974 | Fed. Rep. of Germany . |
| 052344711 | 4/1974 | Fed. Rep. of Germany . |
| 05267657 | 7/1977 | Fed. Rep. of Germany . |

(List continued on next page.)

*Primary Examiner*—John Sipos
*Assistant Examiner*—Linda B. Johnson
*Attorney, Agent, or Firm*—McCormick, Paulding & Huber

[57] ABSTRACT

The invention resides in winder for automatically winding sections of sheet material to form separate tubes. The winder comprises a base, a supply of sheet material and a material drive means on the base for advancing sheet material from the supply towards a station on the base located remotely thereof. A winding means is located at the station for winding a section of the sheet material about itself and about a rotational axis such that the involved section of sheet material is substantially wound in a tubular condition. A cutting means is provided and is located between the drive means and the second rotational axis for cutting the sheet material transversely of its length at points therealong corresponding to the end one section and the beginning of the next successive section to be advanced to the station. The winder further employs fastening means for applying a means to the tube created on the winding means to hold the sheet material in tubular form after the involved tube is released from its holding engagement with the winding means.

45 Claims, 12 Drawing Sheets

FOREIGN PATENT DOCUMENTS

| | | |
|---|---|---|
| 8209958 | 8/1982 | Fed. Rep. of Germany . |
| 3121039 | 12/1982 | Fed. Rep. of Germany . |
| 3125553A1 | 1/1983 | Fed. Rep. of Germany . |
| 3128155 | 2/1983 | Fed. Rep. of Germany . |
| 3151956C2 | 7/1983 | Fed. Rep. of Germany . |
| 315100702 | 8/1983 | Fed. Rep. of Germany . |
| 3309193A1 | 2/1984 | Fed. Rep. of Germany . |
| 3529981 | 2/1987 | Fed. Rep. of Germany . |
| 3714721 | 11/1987 | Fed. Rep. of Germany . |
| 3739341 | 6/1989 | Fed. Rep. of Germany . |
| 3812170 | 10/1989 | Fed. Rep. of Germany . |
| 3835023 | 4/1990 | Fed. Rep. of Germany . |
| 62-269839 | 11/1987 | Japan . |
| 62-290662 | 12/1987 | Japan . |
| 5567999 | 8/1975 | Switzerland . |
| 0715469 | 9/1954 | United Kingdom . |
| 1230994 | 5/1971 | United Kingdom . |
| 1475198 | 6/1977 | United Kingdom . |

CORELESS WINDER AND METHOD OF USE

CROSS-REFERENCE TO RELATED APPLICATIONS

The present invention relates to U.S. application Ser. No. 07/681,861 entitled, READILY TRANSFERABLE TAPE AND METHODS OF MAKING AND USE filed on Apr. 5, 1991 in the name of H. Joseph Gerber, which application being commonly assigned with the assignee of the present invention.

BACKGROUND OF THE INVENTION

This invention relates to a device for automatically winding sheet material and deals more particularly with a method and an apparatus wherein successive sections of a continuous length of sheet material are automatically wound into coreless tubes and are separated from the remaining sheet material length by cutting the material along regions which separate one section from the next and each tube wound by the apparatus is fastened against unravelling.

The paper winder of the invention, is useful for example in the garment industry for winding into separate tubes discrete sections of a continuous web of material, such as paper, onto which a multiplicity of markers or other graphic indicia have been created. The markers represent pattern pieces to be cut from a length of fabric and are usually rapidly drawn on the sheet material by a computer aided plotter which plots the patterns belonging to a single job in a group along a section of the web. The web material which contains these markers is of great length to accommodate the many markers that may make up a single plotting operation, each marker having a length anywhere from two to forty yards. During a plotting operation, sheet material is moved through the plotter from a supply roll across a support surface where the plot is made by an instrument, usually a pen, and is thereafter rolled onto a take-up roll. The sheet material which extends across the support surface between the supply and the take-up rolls is continuous and is entirely transferred from the supply roll to the take-up roll as a result of the successive plotting operations being conducted by the plotter on it. Thus, on a given take-up roll there may be wound sheet material of great length having a multiplicity of markers plotted on it in succession.

In the case where the plotter creates markers each associated with a separate job drawn on an associated section of the length of the web, it had been the practice of workers to manually cut the sheet material along a line corresponding to the break between one job and the beginning of the next. This was so that individual markers could be used as desired, usually by placing over a lay-up and the operator thereafter hand cutting the fabric plies along pattern lines outlined by the overlaid marker. It has been found that although the sections of the sheet material which comprised each marker could be separated by cutting them in this way, many of the cut marker sections are not necessarily immediately used. Accordingly, it is an important to somehow keep the cut sections of sheet material which may extend several tens of feet in a manageable form until such time that there is cause to use them. Also, the sheet material on the take-up roll may vary in width depending, for example, on the size of machine used to make the plot. In this way, it is further necessary to be able to convert otherwise unmanageable cut sections of sheet material into manageable form regardless of variations in the widths of the sheet material used. Additionally, it is desirable to provide a device for this purpose which is capable of being used in conjunction with a plotter or that is equally capable of functioning independently thereof. Providing a stand alone feature in such a device is desirable since it allows the plotter to be used at full capacity to conduct the next series of plotting operations on a separate roll thereby insuring efficiency of use in both machines.

Accordingly, it is an object of the present invention to provide an apparatus for winding discrete sections of a continuous length of sheet material in roll form, such that each section is cut at a transition point along its length between it and the section which follows, and is automatically wound upon itself and fastened against an unravelling.

It is another object of the present invention to provide an apparatus of the aforementioned type wherein means are provided for recognizing the transition point between discrete sections of the sheet material length and for automatically cutting the sheet material transversely of its length generally at this transition point.

It is yet a further object of the present invention to provide an apparatus of the aforementioned type which is a stand alone type capable of winding and rolling into discrete tubes sections of the sheet material initially placed on it as a continuous roll regardless of differing widths which may make up each roll.

A still further object of the present invention is to provide an apparatus of the aforementioned type wherein the effects of coning of material on a take-up roll is compensated for automatically.

A still further object of the present invention is to provide an apparatus of the aforementioned type wherein plural winding, cutting and fastening operations are capable of being conducted in succession automatically on sheet material such that the apparatus can be left essentially unattended by a user.

Yet another object is to provide a winder of the aforementioned type wherein it is capable of being used in conjunction with a plotter.

Other objects and advantages will become apparent from the following disclosure and the appendant claims.

SUMMARY OF THE INVENTION

The invention resides in winder for automatically winding sections of sheet material to form separate tubes. The winder comprises a base, a means for supplying sheet material and a material drive means on the base for advancing sheet material from the supply means towards a station on the base located remotely thereof. A winding means is located at the station for winding a section of the sheet material about itself and about a rotational axis such that the involved section of sheet material is substantially wound in a tubular condition. A cutting means is provided and is located between the drive means and the rotational axis for cutting the sheet material transversely of its length at points therealong corresponding to the end of one section and the beginning of the next successive section to be advanced to the station. The winder further employs fastening means for applying a means to the tube created on the winding means to hold the sheet material in tubular form after the involved tube is released from its holding engagement with the winding means. Control means connects the drive means and the winding means to cause coordinated advancement of sheet material from the drive means to the winding means. Also, the control means is connected to the cutting means and to the fastening means to cause cutting and fastening of the sheet material to be coordinated with its advancement.

The invention further resides in a method for winding the sections of sheet material into separate tubes. The method comprises the steps of advancing the sheet material along a path of travel from a supply of such material to a station disposed remotely thereof; providing means located at the station for winding a discrete length of sheet material about itself and about an axis of rotation; advancing the sheet material to the station and winding it about itself and about the axis of rotation to form a tube of material; cutting the sheet material transversely of its length at a point therealong separating the wound section from that which succeeds it; fastening the cut sheet material section which makes up the tube so that the tube remains held in a tubular form when it is released from the station; and releasing the tube rolled on the winding means and advancing the next section of material to the station for winding and fastening in the same manner.

The invention also resides in a plurality of different devices which may be employed alternatively for the purpose of applying means which holds the cut section of sheet material in a tubular condition.

DETAILED DESCRIPTION OF THE PREFERRED EMBODIMENT

Figure 1:
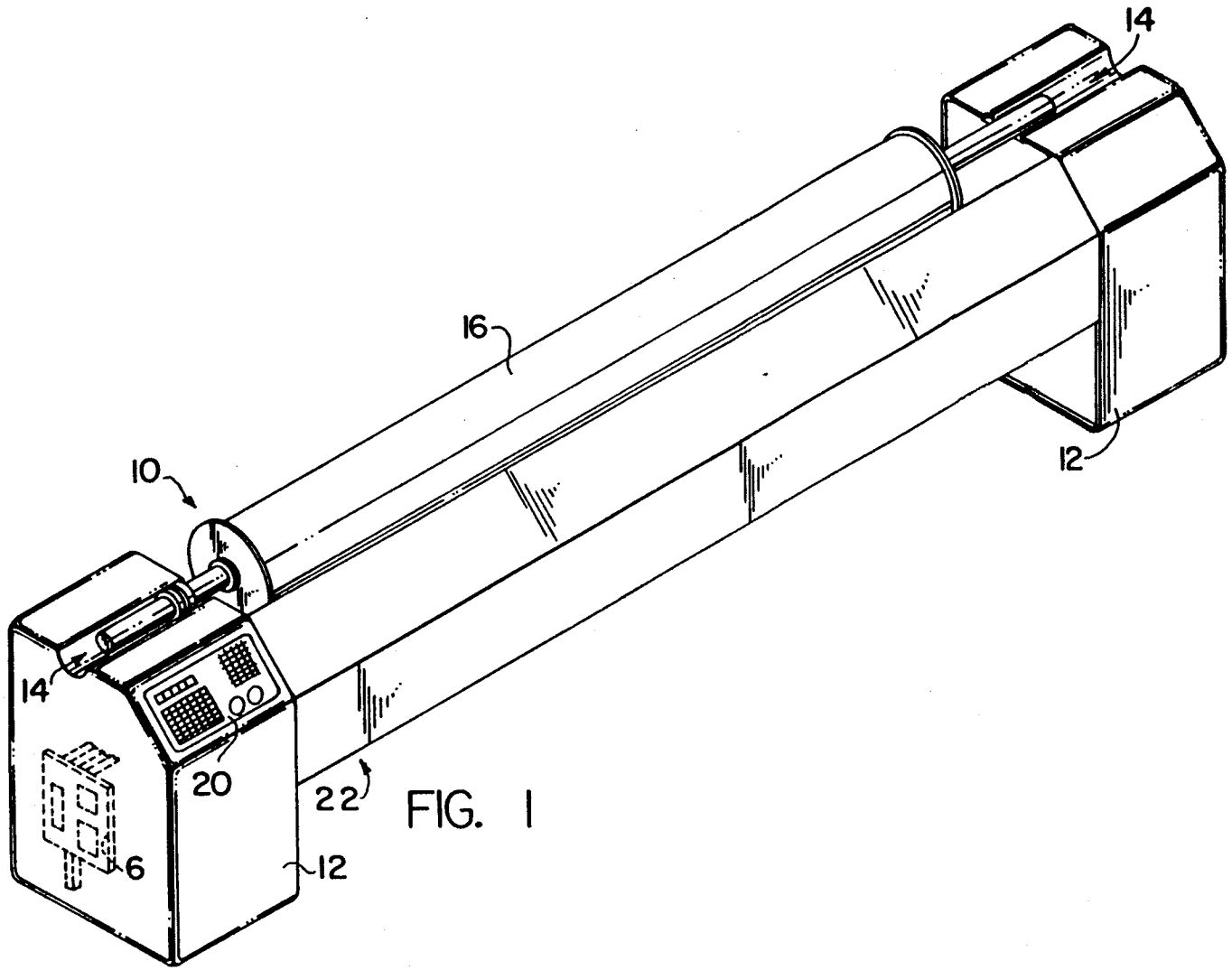
FIG. 1 is a perspective view of the winder embodying the present invention.
Figure 2:
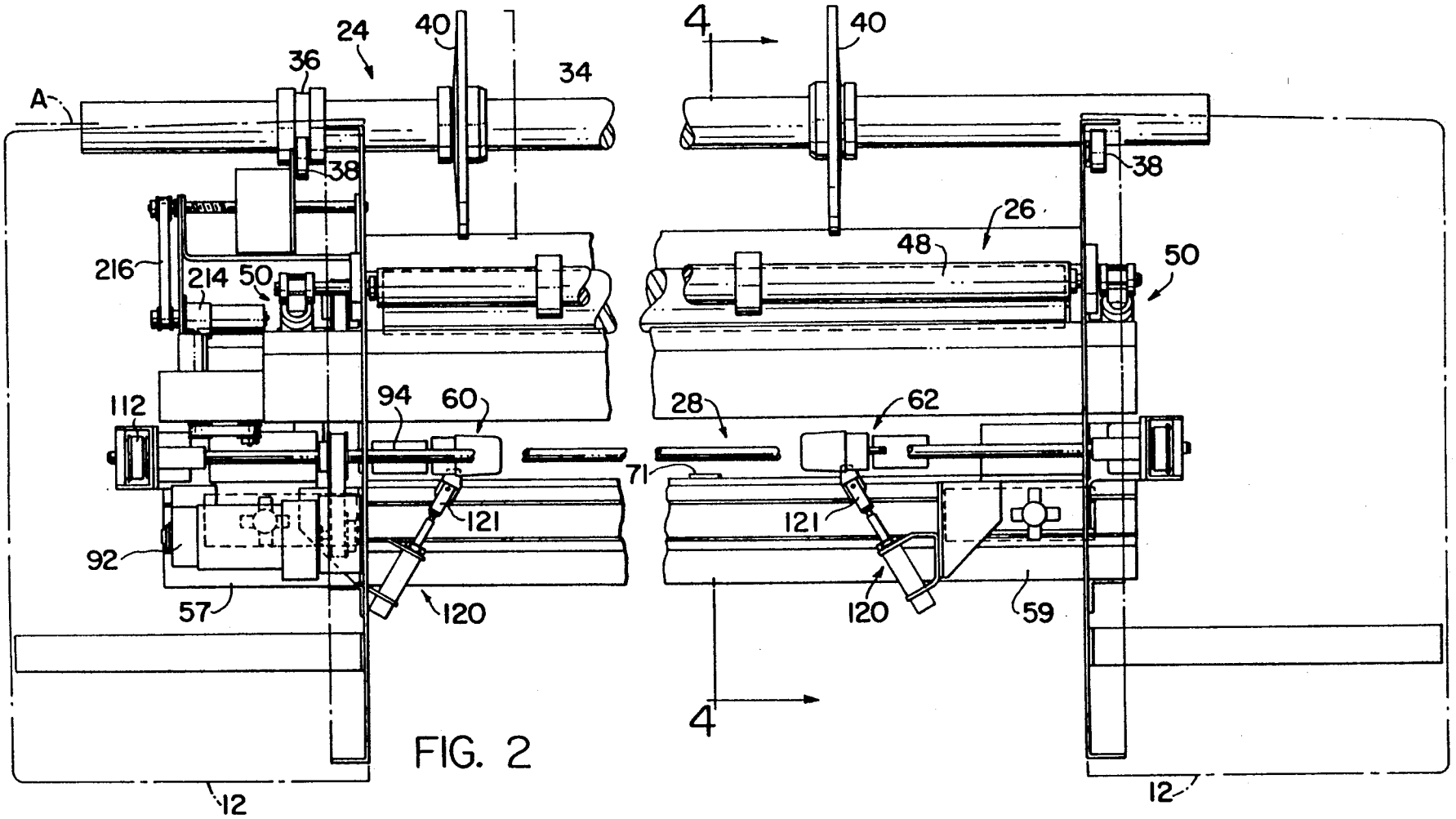
FIG. 2 is a partially fragmentary front elevation view of the winder shown in FIG. 1.
Figure 3:
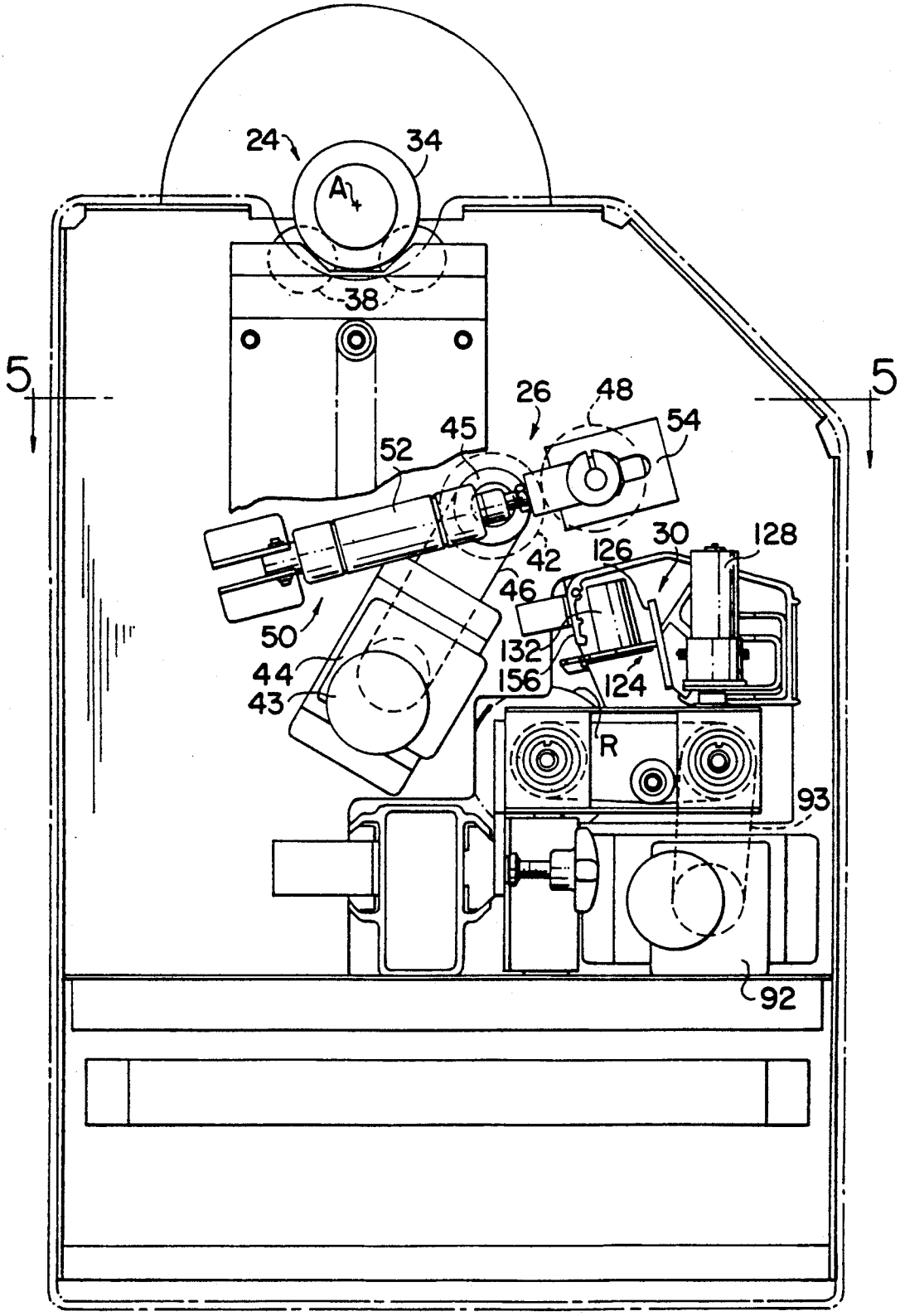
FIG. 3 is a partial fragmentary side elevation view of the winder shown in FIG. 2 looking at it from the left.
Figure 4:
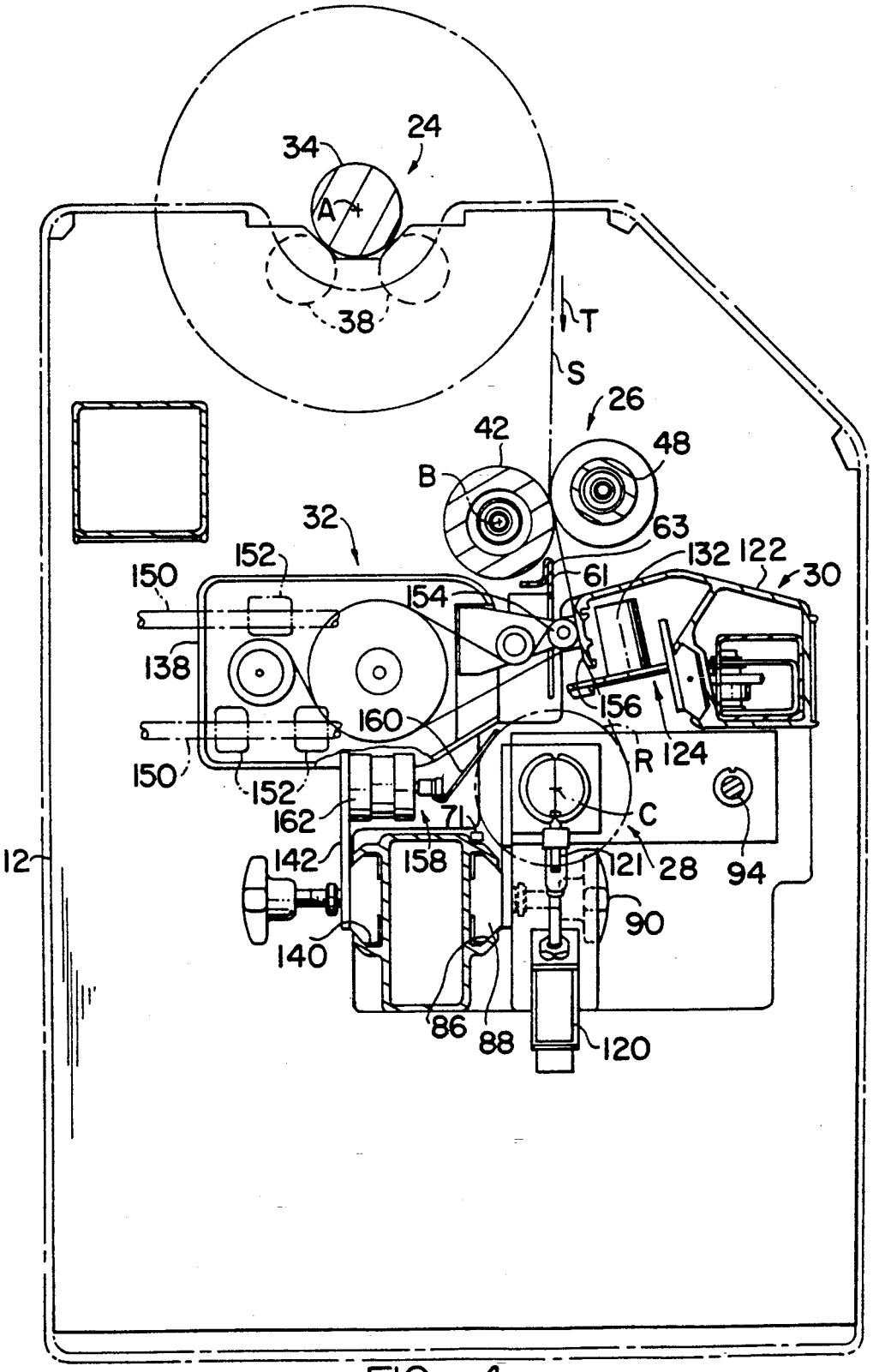
FIG. 4 is a vertical sectional view taken along line 4—4 in FIG. 2.

FIG. 1 shows a winder illustrated generally as 10 embodying the present invention. The winder 10 includes a base 12 having support means 14 for rotatably supporting a roll of sheet material 16 thereon and a control panel 20 having a small LCD readout offering an operator the capability to select from a menu various operations to be accomplished. The control panel 20 is linked to a stand alone controller 6 having a conventional microprocessing unit linked to a memory with sufficient capacity to store and execute commands which cause the winder to perform in a specified manner. Disposed at the lower end of the winder is a discharge 22 from which wound sections of the sheet material constituting the roll 16 are released in a tubular condition in accordance with a broader aspect of the present invention.

The winder 10 further includes means linked to the controller 6 for automatically carrying out operations on the sheet material S ultimately leading to select sections of its length being wound into separate tubes. To this end, as shown in FIGS. 2-5, these means include a material advance drive means 26 for advancing sheet material from a roll toward the discharge 22, a winder means 28 for winding a sheet material into discrete tubes, a cutting means 30 for cutting the sheet material adjacent the tube R formed on the winder means 28 and a fastening means 32 for fastening the sheet material making up the tube to hold it in its cylindrical form.

The rotatable support means 24 includes two pairs of bearing rollers 38,38 each disposed at opposite ends of the base 12 and a generally elongate mandrel 34 suitably sized lengthwise to be supported at its ends by each pair of the rollers 38,38 for rotation about a first rotational axis A. The roll 16 has a core 40 upon which the sheet material S is wound and is retained against axial movement on the mandrel 34 by two collars 40,40 which hold the roll 16 in place on it. Formed at one end of the mandrel 34 is an annularly extending channel 36 correspondingly sized and shaped in cross-section to receive engaging ones of the pair of bearing rollers 38,38 associated with it. As will hereinafter become apparent, the support means 24 further includes means which coact with the channel 36 for insuring that the sheet material is maintained in alignment edgewise during its advancement. For the moment, however it is only necessary to understand that the rollers 38,38 are received within the channel 36 such that the mandrel 34 is maintained thereby against lateral movement relative to the base 12 and that the sheet material is pulled off the roll 16 with the mandrel freely rotating on the bearing roller pair 38,38 which support it.

Advancement of the sheet material S through the winder 10 is effected by the drive means 26 which engages with and causes the sheet material to be pulled from the roll 16 downwardly toward the winding means 28 along an indicated travel path T. To this end, the drive means 26 includes a drive roller 42 rotatably mounted to the base 12 within an appropriate journalling means and is driven in rotation by a drive motor 44 about a second rotational axis B. The drive roller 42 includes an input pulley 45 rotatably coupled to the drive motor through the intermediary of an internally toothed drive belt 46 which connects the output shaft of the drive motor 44 to the roller 42 in a non-slip manner. An encoder 43 associated with the drive motor output shaft is provided as part of the motor 44 and is linked to the controller 6 to provide it with a means for measuring the distance the sheet material is advanced once it engages the drive means.

The drive means 26 further includes a pinch roller 48 freely rotatably mounted at its opposite ends on two holding arms 50,50 each mounted to the base 12 through the intermediary of a double acting actuator 52,52 responsible for moving the pinch roller 48 between an open position wherein the sheet material is capable of being readily fed therebetween and a retracted position wherein the pinch roller is caused to capture the sheet material within the roller bite to maintain it in driving engagement therewith. In its retracted condition the pinch roller is urged against the drive roller 42 by the action of the actuators 52,52. To effect this, the holding arms 50,50 each include a journalling plate 54,54 connected to a sliding rod part of each of the actuators 52,5 and have a means formed therein sized to receive the correspondingly journalling part of the pinch roller 48 such that the plates together allow the pinch roller to be moved between retracted and extended positions while nevertheless being freely rotatably mounted thereon.

Located below the drive means 26 is the winding means 28 so positioned relative to the drive means as to receive the depending edge of the sheet material S as it hangs from the drive means positioned above it. For directing the leading edge of the sheet material into the winding means 28, a guide 63 having a generally vertically extending surface 61 is disposed along the travel path T of the sheet material for this purpose. The winding means includes a first and a second gripper 60 and 62 each secured to the base on an associated support plate 57,59 so as to be disposed along opposite side edges of the sheet material. An optical sensor 71 is secured to the base 12 at a point a few inches below the grippers and provides a means for detecting the presence of the leading edge of the sheet material when it is advanced to this point.

Figure 6:
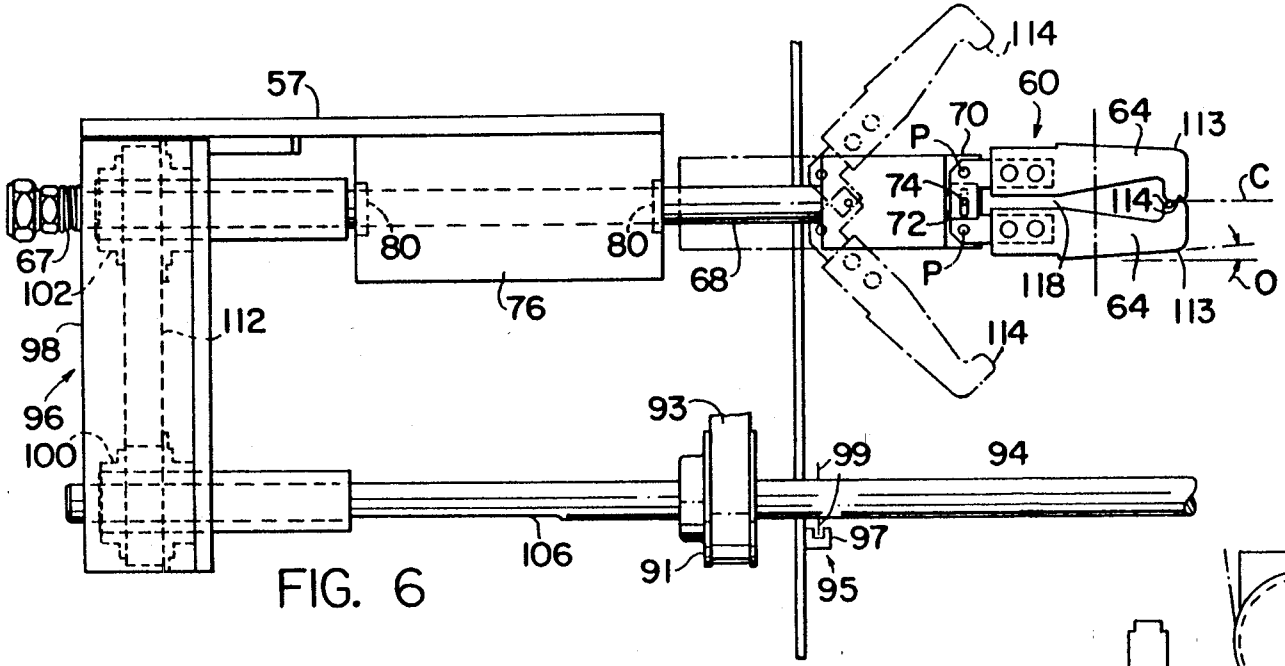
FIG. 6 is a partially fragmentary top view of a gripper and its associated drive system.
Figure 7:
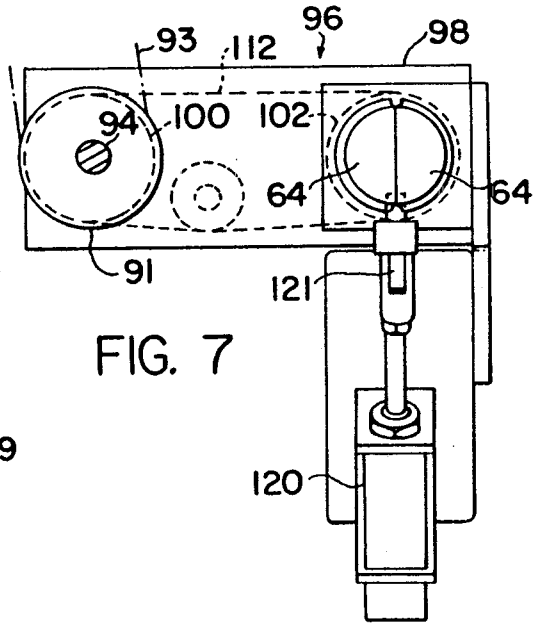
FIG. 7 is a side view of FIG. 6 looking at it from the left and shows the gripper with its stripper assembly.

As seen more particularly in FIGS. 6 and 7, each of the grippers includes a pair of generally elongate engagement members 64,64 pivotally connected to a first actuator 70,70 secured for rotation to an associated support shaft 68,68 for rotation about a third rotational axis C oriented generally parallel to the first and second rotational axes A and B. Each first actuator 70,70 is single acting having a sliding rod 72 disposed therein connected for movement with the engagement members 64,64 through the intermediary of a link pin 74 received within elongate slots formed in the proximate ends of each engagement member 64,64. The engagement members 64,64 are normally spring brassed in an open condition (phantom line) and are prompted by appropriate articulation of the actuator 70 to be moved to a closed condition (solid line) wherein the sheet material is engaged and wound in a manner that will hereinafter become apparent.

The first and second grippers are each supported for both rotational and axial movement within an associated second actuator 76,76 fixed to each of the support plates 57 and 59. For this purpose, each second actuator includes means 80,80 disposed at opposite ends thereof for rotatably slidably journalling an associated one of the shafts 68,68 therein. The second actuators are double acting and each includes a sliding piston secured against movement to the shaft 68,68 received therein for moving the associated one of the first and second grippers axially along the axis C in response to the actuator being selectively energized. The shafts 68,68 are also biassed away from one another along the axis C by spring means 67,67 interposed between each shaft and the support plate which carries it for the purpose of winding the sheet material in a desired manner.

In the preferred embodiment, the first and second actuators are pneumatic type actuators and are connected to a pressurized fluid reservoir contained in the winder by lines which communicate fluid therebetween. Introduction of fluid pressure to these actuators is effected by solenoid valves driven by the controller 6 to controllably introduce fluid into appropriate chambers of each actuator at times designated by the control program. The second actuators 76,76 are connected to a switch having a first vent/pressure mode, a second pressure/vent mode and a third vent/vent mode of operation. The first and second of these modes cause the shaft 68,68 to be positively moved between extended and retracted positions while the third mode causes the grippers to be brassed away from one another by the spring means 67,67. Magnetic sensors (not shown) are provided and generate signals indicating the extended and retracted positions of the grippers.

To accommodate size changes in the widths of the sheet material which may differ from one roll to the next, the support plate 59 is adjustably positionable on the base 12 to consequently move the first and the second gripers relative to one another along the rotational axis C. The means for effecting such positioning includes a transversely extending track 86, a wedge member 88 correspondingly sized and shaped to be slidingly received within the track 86 and a threaded bore formed in the wedge member which receives a correspondingly sized threaded shank 90 carried by the support plate 59. When tighten, the shank 90 draws the involved plate 59 against the base 12 and locks it at the desired position along the track 86 such that when extended, each of the first and second grippers evenly engage with the sheet material S along its side edges.

The first and second grippers 60 and 62 are connected in rotation with one another by means of a torque bar 94 which causes the rotation of one gripper to mirror that of the other. To allow the first and second grippers to be drivingly coupled in this manner while nevertheless being relatively adjustable transversely along the rotational axis C, the invention provides rotational coupling means 96,96 for this purpose. As seen in FIGS. 6 and 7, each coupling means 96,96 includes a generally rectangular box or housing 98,98 which is fixed at one end to an associated one of the support plates 57 and 59 so as to be cantilevered outwardly therefrom. Journalled within each housing 98,98 are a drive pulley 100 and a driven pulley 102 rotatably coupled to one another by a belt 112. The drive and the driven pulleys each have a series of teeth circumferentially outwardly disposed thereabout which engage with correspondingly sized and spaced teeth formed on the inner surface of the drive belt 112.

The drive pulley 100,100 within each coupling box is adapted to slidingly yet nonrotatably engage the torque bar 94. For this, each drive pulley has a through central opening with a projection extending radially inwardly therefrom correspondingly sized and shaped to be received within a lengthwise extending key way 106 formed along the torque bar 94. Each driven pulley 102,102 is connected to an associated one of the shafts 68,68 proximate its free end such that it is held thereon against both axial and rotational movement by conventional means, such as a set screw. In a like manner, an input pulley 91 is nonrotatably secured to the torque bar at a location thereon adjacent the support plate 57 and is driven in rotation with it by a drive motor 92 having an output pulley rotatably coupled to the torque bar 94 in a non-slip manner by an internally toothed drive belt 93 coacting with correspondingly sized and spaced teeth outwardly disposed on each of these pulleys. It should thus be seen that the coupling means 96,96 permits the first and second grippers to be adjustably positioned relative to one another while nevertheless maintaining a drive connection therewith.

As illustrated, each of the engagement members 64,64 which comprise the first and the second grippers 60 and 62 has an outwardly disposed arcuate surface 114,114 about which the sheet material S is wound. The engagement members 64,64 of each pair, which when caused to be closed by the action of the first actuator 70, contact one another along inwardly directed gripping faces 114,114 located along the distal end regions thereof. The gripping faces meet along a plane which includes the rotational axis C so as to maintain juxtaposed engagement members in a spatial relationship with one another to define a gap 118 therebetween. The gripping faces 114,114 may include replaceable inserts secured to each engagement member by appropriate means for the purpose of providing different textured gripping surfaces.

A stripper means 120 is provided for each gripper and is supported on the base 12 adjacent to it. This means includes a finger 121 controllably articulated between an extended position wherein its tip projects within the gap 118 of the associated gripper and a retracted position wherein the finger stands clear of it. When the grippers are closed and properly oriented, the gap 118,118 allows the finger 121 to be received within the space defined thereby to effectively insure pull off of the tube of sheet material wound on the grippers in accordance with a further aspect of the invention which will hereinafter be discussed with reference to the method of operation of the winder. To aid in this pulling off process, outer surfaces 114,114 of the engagement members taper inwardly toward the rotational axis C proceeding away from its respective pivot point P and towards the free ends thereof. The indicated angle taper angle 0 is very slight on the order of about 5 degrees allowing the sheet material to be wound in a circular manner while nevertheless permitting the first and second grippers to be readily pulled from within the tube which surrounds them.

The grippers 60 and 62 are controllably rotated with reference to a home position defined by each of the gaps 118,118 being aligned coincidentally with the path of travel T of the sheet material S when the grippers are in a home position. To this end, a rotational sensing means 95 linked to the controller 6 is provided and includes a sensor 97 and a pair of indicators 99,99 which interact with the sensor 97 to indicate their presence with each pass. The indicators 99,99 are nonrotatably secured to the torque bar 94 and are in angular coincidence with the gaps 118,118 such that with each 180 degree rotation of the bar from the home position, the controller by interrogating the means 95 knows when the gaps 118,118 are in alignment with the path T travelled by the sheet material S.

Figure 8:
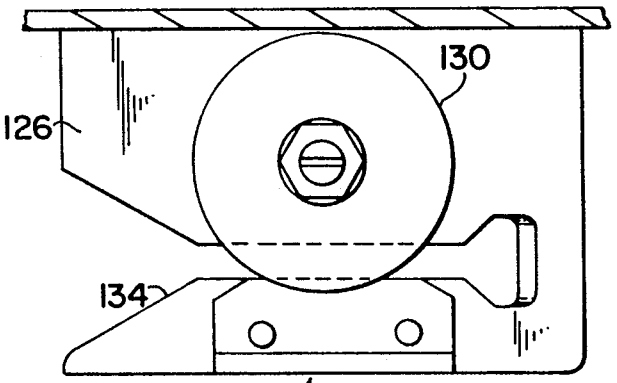
FIG. 8 is a plan view of the cutter carriage and shows the paper throat means.

For cutting a discrete length of sheet material S which has been advanced through the winder 10, the cutting means 30 is situated between the drive means 26 and the winding means 28 along the path travelled by the sheet material S through the winder. The cutting means 30 includes a generally horizontally disposed way 122 supported by the base 12 and a cutter assembly 124 travelling along the way across the travel path T of the sheet material S. The cutter assembly 124 includes a carriage 126 moveable along the way and driven in either direction by a positioning motor 128 disposed at one end of the way and connected to the carriage by a conventional cable drive system. The cutter assembly 124 further includes a circular serrated cutting blade 130 rotatably driven about a central axis by a cutting motor 132 which causes the sheet material to be cut along a line which tracks along the way 122. The carriage 126 is normally located at a home position which may, depending on the width of the sheet material, be spaced some distance from the nearest side edge of the sheet material. To insure a registry of this side edge with the cutting blade 130 as the carriage 126 is moved into engagement with it, a means indicated in FIG. 8 as 134 is disposed at the leading portion of the carriage is provided. The means 134 includes a tapered slot or throat opening from a point proximate the blade 130 to a final point several times larger than a given thickness of the sheet material so as to capture the leading side edge of sheet material and direct it to the blade with the continued advancement of the carriage 126 from its home position. The cutting means 30 further includes a sensor which is disposed adjacent the home position of the carriage 126 and is connected to the controller 6 to indicate to it that a cutting operation has been completed.

The fastening means 32 is located along the travel, path T of the sheet material S generally adjacent the winding means 28 for the purpose of applying a means for holding the cut trailing end of the sheet material in place on the tube of material which has been wound by the winding means 28. The fastening means 32 may in one embodiment of the invention take the form of a tape applicator 138 adjustably secured to the base 12 along a channel 140 by a holding bracket 142. In this way, the position of the fastening means can be adjusted widthwise such that the applied holding means is delivered on the tube approximately midway along of its length or two applicators maybe used each located along the channel 140 so as to apply adhesive at the opposite ends of the tube.

Figure 5:
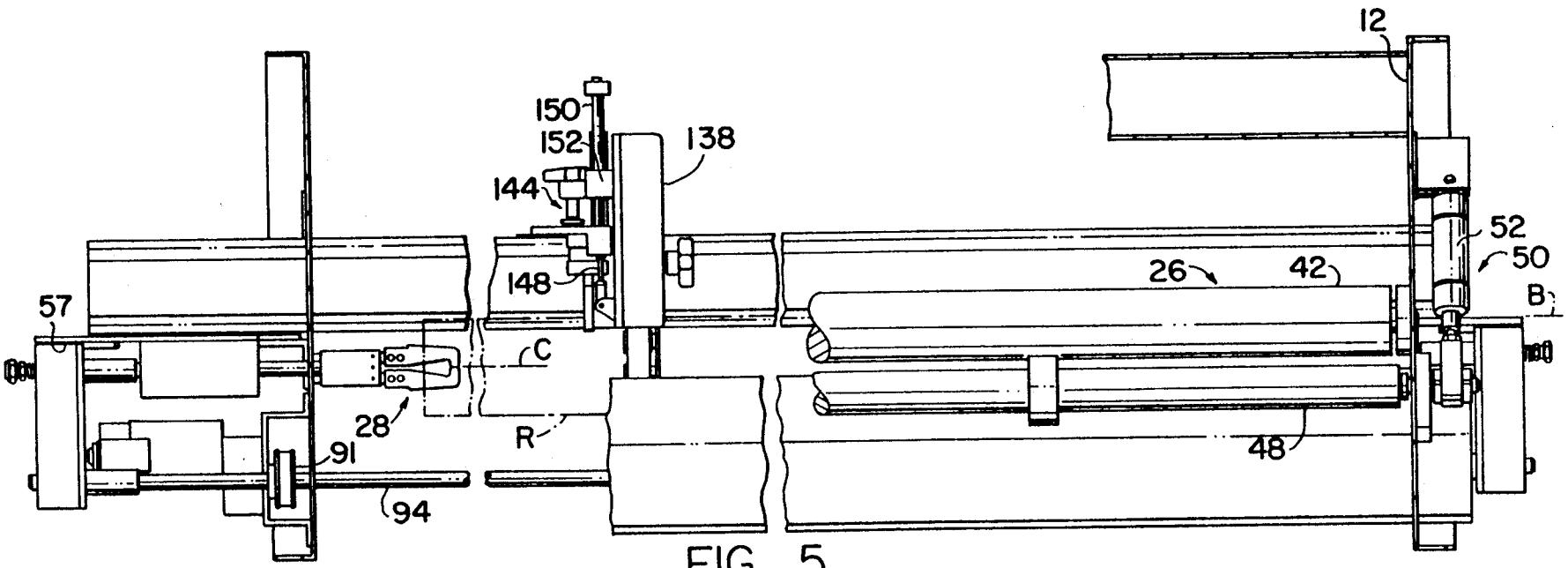
FIG. 5 is a partially fragmentary horizontal sectional view taken along line 5—5 in FIG. 3.

As seen in FIG. 5, the tape applicator 138 is moveable relative to the bracket which supports it through the intermediary of a slide actuator means 144. This means includes an actuator having a sliding rod 148 connected for movement with the applicator 138 between extended and retracted positions. Bearing members 152,152 are secured to the applicator and travel along a pair of guides 150,150 carried by the bracket 142 for moving the applicator into and out of engagement with the sheet material S. Interposed between the applicator 138 and the bracket 142 is a compression spring which aids in cleanly pulling the applicator away from the sheet material after application of the adhesive is complete. The tape applicator 138 is one such as disclosed in the aforementioned co-pending U.S. application Ser. No. 07/681,861 filed on Apr. 5, 1991 entitled READILY TRANSFERABLE TAPE AND METHODS OF MAKING AND USE, which application being hereby incorporated by reference in the present application. As disclosed therein, the applicator 138 has a contact roller 154 disposed outwardly thereof for engaging the back face of the sheet material S and applying a strip of adhesive to it.

For aiding in this process, a material support surface 156 is provided on the base 12 and cooperates with the contact roller 154 to provide a fixed surface with which the contact roller cooperates to apply the adhesive onto the sheet material. The contact roller is formed from a frictional material, such as rubber, and has a length as measured along its elongate dimension which is slightly greater than the width of the tape exposing a portion of the contact roller to the sheet material such that as the sheet material is advanced, pads of adhesive are transferred in succession from the applicator to the sheet material in the disclosed manner.

The fastening means 32 further includes a wrapper means 158 supported by the bracket 142 and selectively caused to engage the outer surface of the sheet material S wound about the first and second grippers to compress the adhesive or other sticky material deposited on its trailing end onto the tube R which underlies it. For this, the wrapper means 158 includes a resilient leaf spring 160 connected at one end to an actuator 162 positioned generally adjacent the winding means 28. The leaf spring 160 is bent along its length and is so secured to the sliding rod of the actuator 162 as to engage tangentially on the tube R when the rod is extended thereby compressing the outer turn with continued rotation by the winding means 28.

Figure 9A:
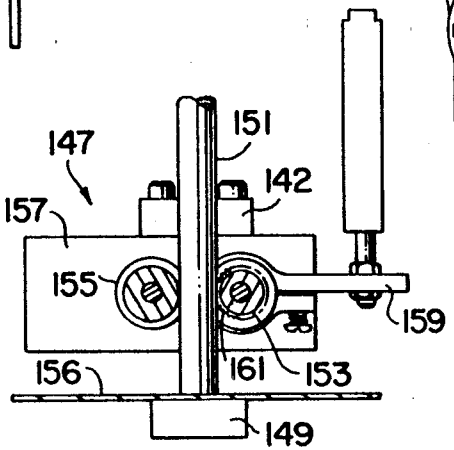
FIG. 9A is a horizontal view through the winder showing a second alternate embodiment of the fastening means wherein a hot glue applicator is employed.
Figure 9B:
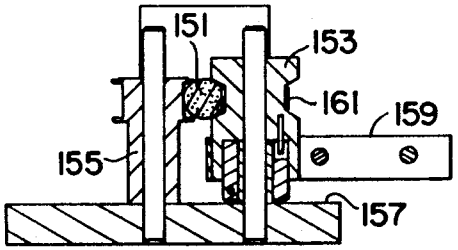
FIG. 9B is a front elevation view of the glue applicator of FIG. 9A.

In FIGS. 9A and 9B a second embodiment of the fastening means 32 is illustrated. In this embodiment, the fastening means is comprised of a heating element 149 disposed on the support surface 156 and a glue applicator means 147 mounted to the bracket 142. The glue applicator means 147 includes a generally elongate cylindrical glue stick 151, a drive roller 153 and a support roller 155 connected for rotation to a base plate 157. Each of the drive and support rollers as shown in FIG. 9B has a generally concave profile having a radius curvature generally equalling that of the glue stick 151. The drive roller 153 is intermittently drivingly connected to a crank 159 through the intermediary of a one way clutch disposed between the roller and the shaft about which it is mounted to the base plate 157. The crank 159 at its free end is connected to the reciprocating rod of an actuator which causes the drive roller153 to be ratcheted to thereby advance the glue stick towards heating element 149 with each stroke. To effect positive engagement between the drive roller 153 and the glue stick 151, a series of serrations 161 are provided on the drive roller 153 for engaging with and contacting the glue stick surface. It being noted that the heating element 149 is disposed on the opposite side of the sheet material and is sufficiently hot, for example on the order of two to three hundred degrees F., to melt the tip of the glue stick through the sheet which is usually paper, but does not burn it.

Figure 10:
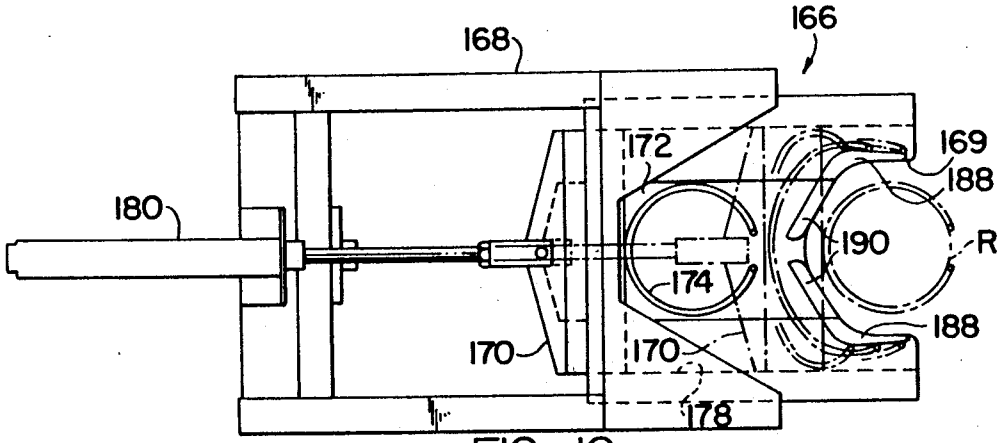
FIG. 10 shows a third alternative embodiment of the fastening means herein shown as a clip dispenser.

In FIG. 10 a third alternative embodiment of the fastening means 32 is shown. Here the fastening means comprises a clip dispenser 166 positioned on the bracket 142 at a height therealong generally even with the rotational axis C of the winding means 28. The clip dispenser 166 includes a base plate 168, a shuttle member 170, a chambering means 172 cooperating with the shuttle member 170 and a supply of resilient clips 174 which are fed sideways into the chambering mechanism 172. The shuttle member 170 is a generally a flat stiff plate guided within the chambering means 172 along a channel 178 which causes it to move along a straight line path into and out of the chambering means 172. The shuttle member 170 is reciprocated in this manner by an actuator 180 which drives it between retracted and extended positions. The supply of clips 174 are arranged side-by-side with one another and are urged by appropriate brassing means into the chambering means. The clips 174 are of a thickness such that when urged in this manner, the shuttle member 170 strikes and advances only the leading one of the clips 175 from the stack which comprises the supply.

The clips 174 which comprise the supply 174 are formed form a hard plastic material which is capable of being expanded to a certain degree, but have a memory characteristic urging them back into a relaxed unexpanded state. For spreading the free ends of each clip apart in order to place it over the tube R instantly wound on the gripper means 28, the chambering means 172 includes a ramping means 188 having two symmetrically disposed camming surfaces 190,190 which initially separate the leading end edges of a clip 174 as it is urged outwardly by the shuttle member 170. With continued movement of the shuttle member into the chambering means 172, the clip ends are caused to be expanded and upon reaching the widest distance between the camming surfaces 192,192, the clips thereafter release from engagement on the camming surfaces 190,190 and fasten about the tube held by the winding means 28. For positioning the clip to be applied to the wound tube, the base plate 168 has a cut-out 169 so configured as to receive the corresponding curvature of the tube R when the clip dispenser is moved into its general proximity by an actuator mounted between the dispenser and the bracket which supports it.

Figure 11:
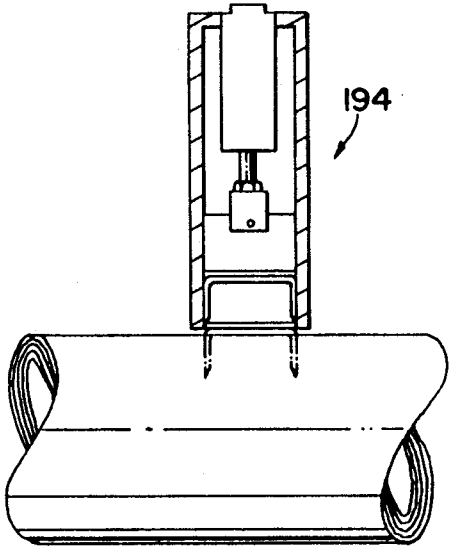
FIG. 11 shows a fourth alternative embodiment of the fastening means herein shown as an automatic stapler.

In FIG. 11 a fourth embodiment of the fastening means 32 is shown. Here the fastening means includes an automatic stapler means 194 supported on the bracket 142 generally even with the rotational axis C of the winding means 28. The stapler means 194 is moveable between a retracted and an extended position relative to the bracket which supports it by an actuator in a manner similar to that disclosed with reference to the tape applicator 138 discussed above. The stapler 194 may be one of a number of commercially available powered staplers and includes a supply of staples which are driven into the tube R while it is wound about the winding means 28. The stapler means also includes the wrapper means 58 which in the case of the automatic stapler means 194 and the clip dispenser 166 is disposed along side it to prevent the material from becoming unravelled during the fastening operation.

Figure 12:
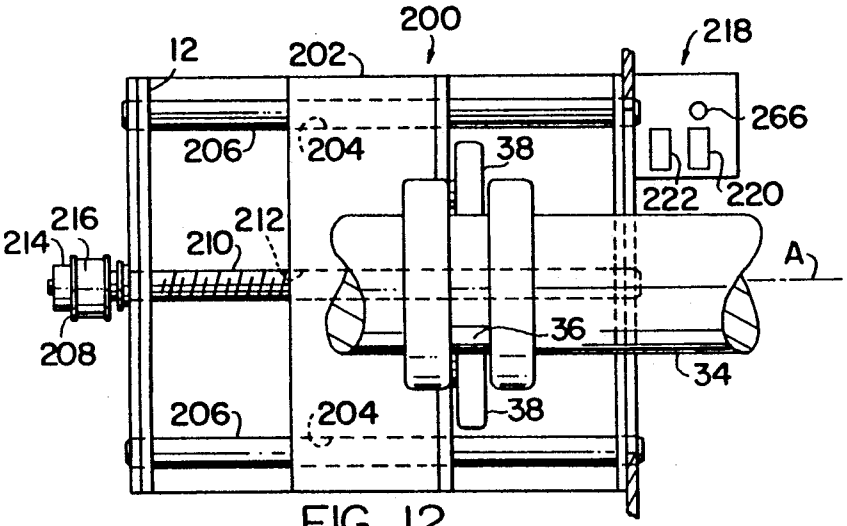
FIG. 12 is a top partially fragmentary view of the paper slewing cone compensating means.
Figure 13A:
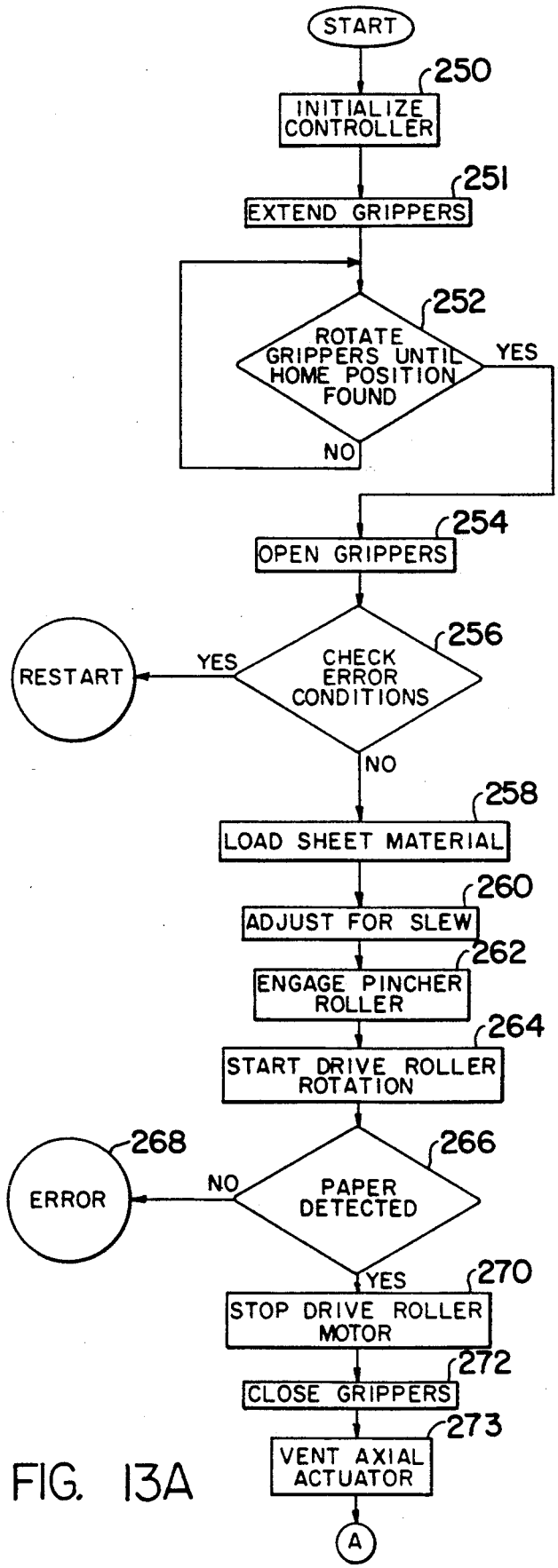
FIGS. 13A-13C illustrate a flowchart showing the operation of the winder in accordance with a method of operation of the present invention.
Figure 13B:
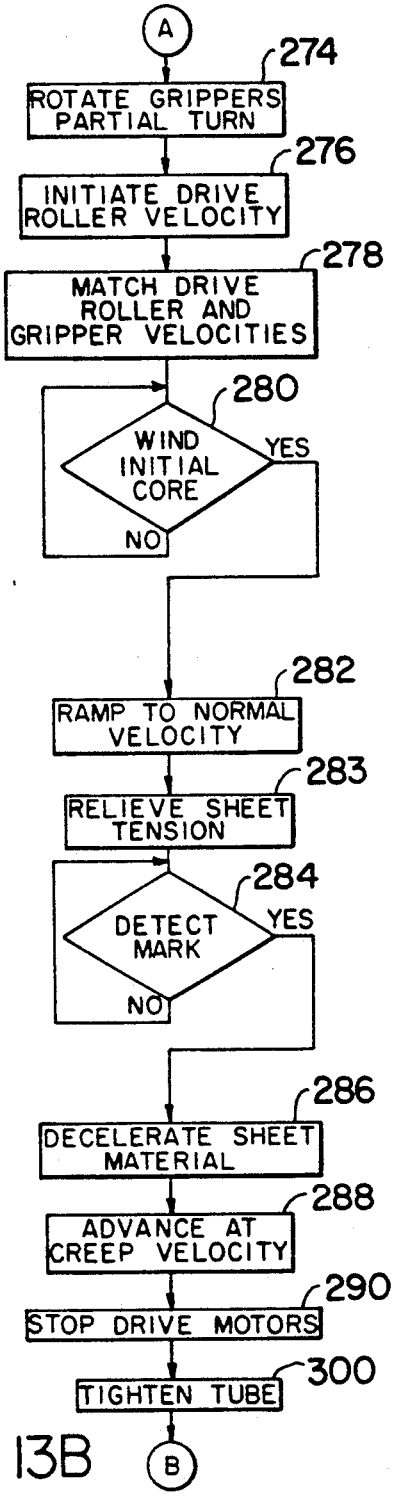
Figure 13C:
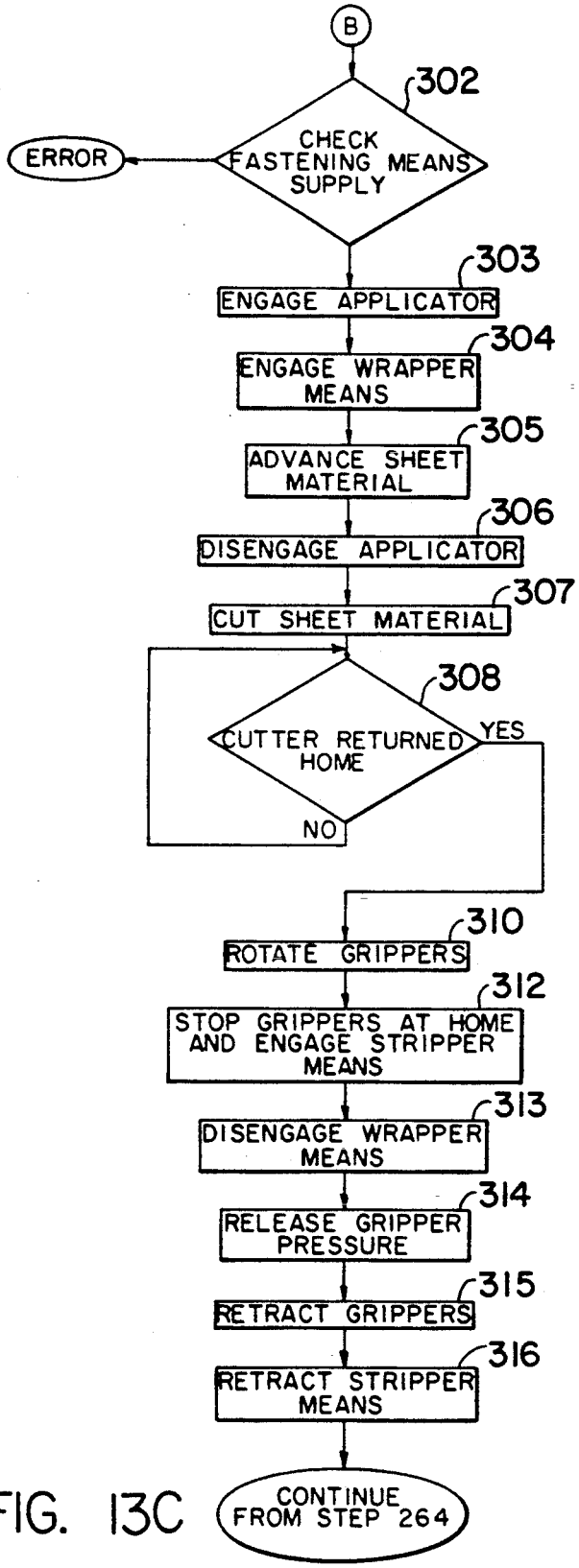

To compensate for coning of the sheet material which may occur about the core of the roll 16 or for other factors which may cause the sheet material S to slew during its advancement, a means 200 shown in FIG. 12 is provided and is included as apart of the support means 24 for this purpose. The means 200 includes a drive block 202 having a plurality of openings 204, 204 formed therein correspondingly sized and shaped to receive an associated guide bar 206 secured against movement to the base 12. The block 202 rotatably supports the bearing rollers 38,38 which are associated with the mandrel end at which the channel 36 is disposed.

The guide bars 206 are disposed generally parallel to the rotational axis A of the mandrel 34 and the block 202 is driven therealong on the guide bars 206 by a drive means 208 connected between the block 202 and the base 12. The drive means 208 in the illustrated example includes a lead screw 210, a threaded opening 212 formed in the block 202 and a drive motor 214 mounted to the base 12 and rotatably coupled to the lead screw 210 by a drive belt 216. The lead screw 210 is disposed substantially parallel to each of the guide bars 206 and threadily engages within the opening 212 so as to be controllably driven in rotation by the motor 214 in either rotational direction to drive the block 202 and consequently the mandrel 34 laterally.

For automatically effecting the edgewise positioning of the sheet material S, the means 200 further includes a sensing means 218 located generally adjacent one end edge of the sheet material S on the side of the first gripper 60 to provide a datum from which slewing of a side edge of the sheet material may be detected as it is advanced through the winder by the drive means 26. The sensing means 218 includes a two component sensor comprised of a first sensor 220 located inwardly of the involved lateral side edge and a second sensor 222 disposed laterally outwardly thereof. The controller 6 interrogates the first and the second sensors periodically to establish any change from an original condition wherein the first sensor is covered by the sheet material and the second sensor remains exposed. In response to any deviation from this condition, the controller energizes the drive motor 214 in either rotational direction depending on the directional compensation needed to correct the variance. It is noted that the means 200 also includes right and left slew control buttons provided on the panel 20 which allow initial alignment of the sheet material with the datum to be effected. Included as part of the sensing means 218 is a marker identifying sensor 266 located in line with the first sensor 220 for detecting the presence of indicia formed on the sheet material as will become more apparent later.

The operator begins the sequence of steps leading ultimately to the winding of discrete sections of the sheet material S into separate tubes by generating a start command received by the controller 6. This prompts the controller to be initialized and sets all actuators to their initial state in a conventional manner (step 250). If not already in an extended condition, the grippers are extended by appropriate articulation of the second actuators and thereafter await initialization (step 251). Thereafter, the first and second grippers 60 and 62 are initialized such that each gripper is first closed, retracted and subsequently caused to be rotated by the drive motor 92 until the angular sensing means 95 indicates that the grippers are in a home position at which point the grippers are stopped (step 252). The grippers 60 and 62 are next caused to be opened (step 254) in which condition the grippers remain until prompted closed by a subsequent command. Other system checks are carried out to establish the status of the adhesive remaining in the tape applicator 138 or, for example, that of the clip supply in the clip dispenser 166 (step 256). If an error condition is established, the start-up process stops here and awaits correction of the condition and a system restart. The paper is next loaded into the machine (step 258) and any needed right and left adjustment of the sheet material edge taken relative to the datum defined by the first and second sensors 220 and 222 is accomplished manually by the operator working the right and left slew keys (step 260). The holding arms 50,50 are subsequently energized and move the pinch roller 48 away from the drive roller 42 to allow the leading end of the sheet material to be received therebetween. Once the sheet material is fed, the holding arms 50,50 are retracted causing the pinch roller 48 to clamp down on the sheet material (step 262) under the urging of the actuators 52,52. The drive motor 44 is then energized and rotates the drive roller 42 to feed the leading edge of the sheet material into the open first and second grippers 60 and 62. The sensor 71 is interrogated for a predetermined interval (step 266) while the sheet material is so advanced and if no sheet material is detected in that interval, an error signal (step 268) is issued. If the sensor 71 detects the sheet material, then the drive motor 44 is stopped (step 270) and the first and second grippers 60 and 62 are caused to be closed such that the confronting gripping faces 114,114 clamp the sheet material at a distance from its leading end equalling about an inch (step 272). At this point, the second actuators 76,76 are placed in a vent/vent condition allowing the axial biassing means 67,67 to act on the leading edge of the sheet material causing it to be pulled taut and thereby be readily tucked with the continued rotation of the grippers (step 273).

Figure 14A:
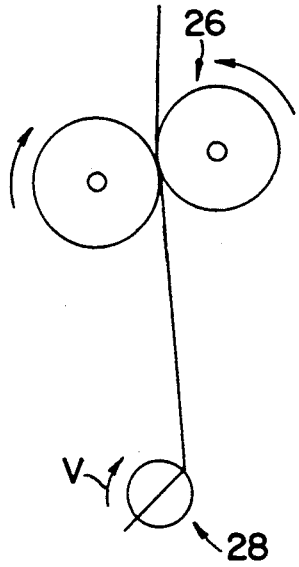
FIGS. 14A-14C illustrate schematically the initial winding of the sheet material into tubes.
Figure 14B:
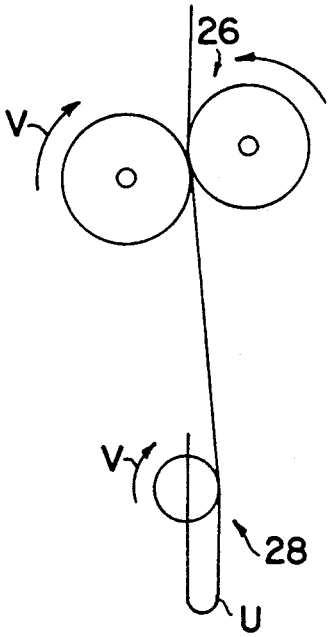
Figure 14C:
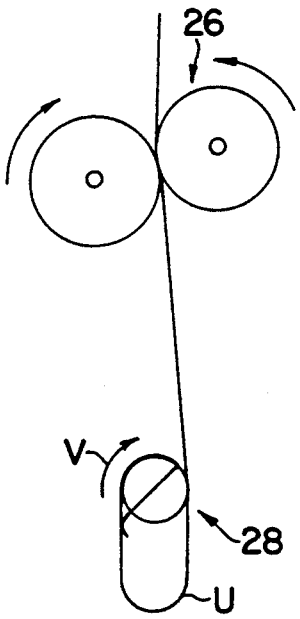

As shown in FIGS. 14A-C, winding of the sheet material on the grippers 60 and 62 is done in concert with the advancement of sheet material through the drive means 26, such that the sheet material is wound evenly and without kinks or creases formed in it. To this end, the controller 20 causes the grippers 60 and 62 to rotate in unison as Shown in FIG. 14A approximately 1/8 of a turn in the indicated V rotational direction at a first starting velocity equally, for example, approximately 1 inch per second. During this period, the drive motor 44 remains electronically braked until the initial one eighth turn by the grippers is completed (step 274). Once this initial rotation is complete, the drive motor 44 is released from its braked condition and causes the drive roller 42 to be driven in the indicated V rotational direction at a speed of approximately 5 inches per second while the grippers are caused to continue to rotate at their initial 1 inch per second velocity (step 276). This velocity differential creates the indicated loop U shown in FIG. 14B and when the grippers complete the first half revolution thereby orienting the gripped leading portion generally parallel to the sheet material S extending downwardly from the drive means as shown in FIG. 14B, the controller 6 then matches the velocity of the drive roller 42 with that of the grippers for the next three and one half turns so that the loop U is maintained during this initial winding stage (step 278). The sheet material continues to be wound in this manner such that its leading edge is tucked by this rotation as shown in FIG. 14C and until a satisfactory core of sheet material has been wound (step 280). This is accomplished after approximately four initial revolutions, and thereafter the velocities of the drive roller 26 and that of the grippers 60 and 62 are ramped to their normal operating velocities equalling, for example around 10 inches per second (step 282). The maximum velocity at which the grippers are rotated is slightly greater than that of the drive roller 26 which eventually causes the loop U to be taken up and the sheet material to become Somewhat tensioned in its advancement. To relieve this tension, the holding arms 50,50 are caused to move the pinch roller 48 out of contact with the sheet material at given intervals, for example every three seconds (step 283).

For indicating the end of one section of sheet material and the beginning of another, a non-reflective rectangular mark or series of marks is provided on the sheet material adjacent one lateral end thereof. The mark interacts with the marker identifying sensor 266 and when detected (step 284) causes the controller to decrease the velocity of the sheet material through the winder such that the mark is stopped in coincidence with the tape applicator 138. To this end, once such a detection is made, the controller decelerates the gripper drive motor 92 and the drive roller motor 44 together to a creep velocity of about one inch per second (step 286). At this same time, a distance counter is set to zero and through input gained from the drive motor encoder means 43, the distance that the mark is being advanced from its initial detection is calculated until it is determined that the mark has been advanced a known distance corresponding to its being located coincident with the tape applicator (step 288). Once advancement to this point is complete, the controller stops the drive roller motor 44 and the gripper drive motor 92 and applies the electronic brake associated with each motor (step 290).

At this point it is desirable to slightly tighten the tube R so as to cause the sheet material to be pulled taut between the drive means 26 and the first and second grippers 60 and 62. This is accomplished by driving the first and second grippers 60 and 62 in rotation in the indicated direction V for about I second at the creep velocity while maintaining the brake on the drive roller motor 44 (step 300). It being noted that the gripper drive motor 92 has a tension sensor which permits the sheet material to be slightly tightened between the drive means 26 and the first and second grippers 60 and 62 without causing the sheet material to be torn.

The fastening means 32 is again checked (step 302) to insure that an adequate supply of material needed to hold the cut end of sheet material to the tube is provided. If no inadequacy is found, the actuator 146 which supports the fastening means, for example the tape applicator 138, is caused to be energized to place the contact roller 154 into engagement with the sheet material (step 303). The wrapper means 158 is then energized (step 304) so as to move the leaf spring 160 into engagement with the outer surface of the tube R thereby compressing the outermost turn of Sheet material inwardly. The drive roller motor 44 and the gripper drive motor 92 are then caused to rotate at creep velocity in unison in the V rotational direction (step 305) advancing the sheet material about a half inch so as to apply an adhesive film to the sheet material in a manner heretofore discussed with reference to the aforementioned application entitled READILY TRANSFERABLE TAPE AND METHODS OF MAKING AND USE. The tape applicator is then retracted (step 306) the paper is advanced and the cutting assembly 124 is activated causing the cutting blade to rotate at a high speed and the positioning motor 128 to be energized and move the carriage 126 along its path of cut (step 307) until the home sensor indicates the carriage has returned to its home position (step 308). Whereupon, the gripper drive motor 92 is subsequently energized and the tube R thereafter is wound two times about the axis C in order to adequately assure that it has been fastened together (step 310).

After this, the gripper drive motor 92 is stopped and the stripper means 120 is actuated to locate the tip of each finger within each gap 118 (step 312). It being noted that the grippers in step 312 are stopped from rotating in their home positions thereby allowing the stripper means to engage. The wrapper means is hence disengaged (step 313) and the first actuators 70,70 are deenergized causing the gripping faces of each gripper to be released from clamping engagement with the sheet material (step 314). With this the controller causes the second actuators 76,76 to simultaneously retract the first and second grippers from the extended Positions (Step 315) and in so doing, the fingers 121,121 of the stripper means act upon the tube R to hold the end edges thereof against movement as the grippers are withdrawn thus allowing it to fall away from the winder 10 at the discharge 22. After this, the fingers of the stripper means 120 are returned to retracted positions out of the way of the grippers (step 316) and a slight delay is provided during this period to allow the tube to clear the wider and be contained in an appropriate holding means, such as a box or other container. Subsequently, the first and second grippers are again extended and opened whereupon the process of advancing the next section of sheet material is accomplished beginning again at step 264. It is noted that all during this time the edge position sensing means 200 tracks the lateral side edge of the sheet material during its advancement to avoid slewing of the material and to insure that the sheet material is wrapped around the grippers edgewise evenly.

Referring back now to the alternative embodiments of FIGS. 9, 10 and 11, it should be seen that where the fastening means constitutes the glue applicator 147, the sequence is essentially the same as that disclosed for the tape applicator 138. That is, at step 303 the tip of the glue stick is advanced into engagement with the sheet material and at the same time the heating element 149 is energized such that when the glue stick is retracted, the melted glue is transferred onto the surface of the sheet material. The process is somewhat different where the fastening means 32 takes the form of a plastic dispenser or the automatic stapler in that the engagement with the sheet material to effect relative movement therewith as set forth in steps 303 and 305 is not needed. Rather, the sheet material is cut first and wound with the cooperation of the wrapper means 158 and is subsequently fastened by either the clip dispenser or the automatic stapler which is brought into engagement with the tube R.

Figure 15A:
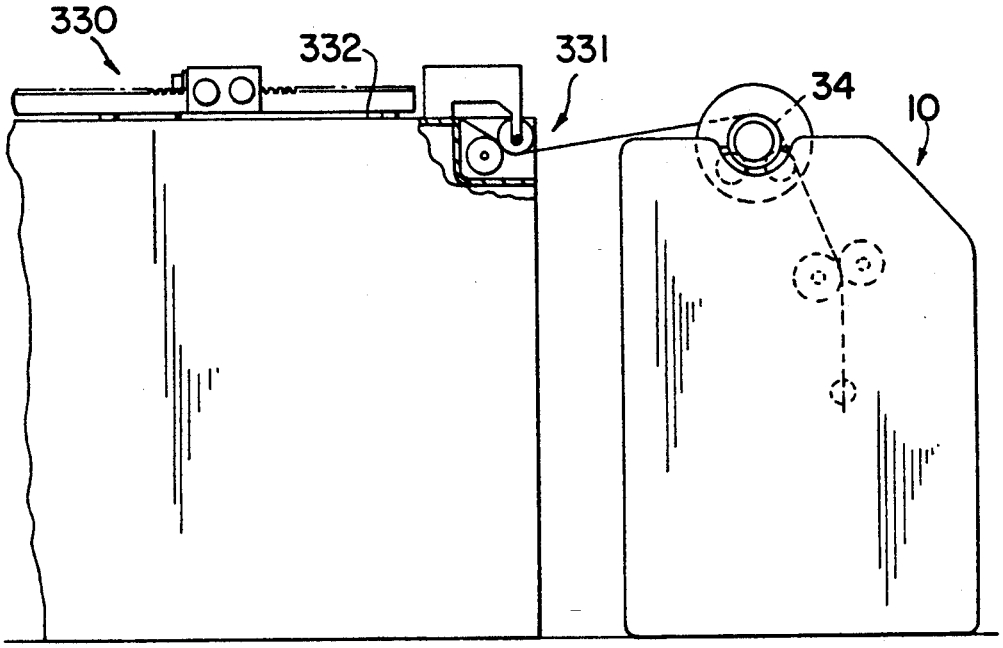
FIGS. 15A and 15B show a winder used in combination with a plotter.
Figure 15B:
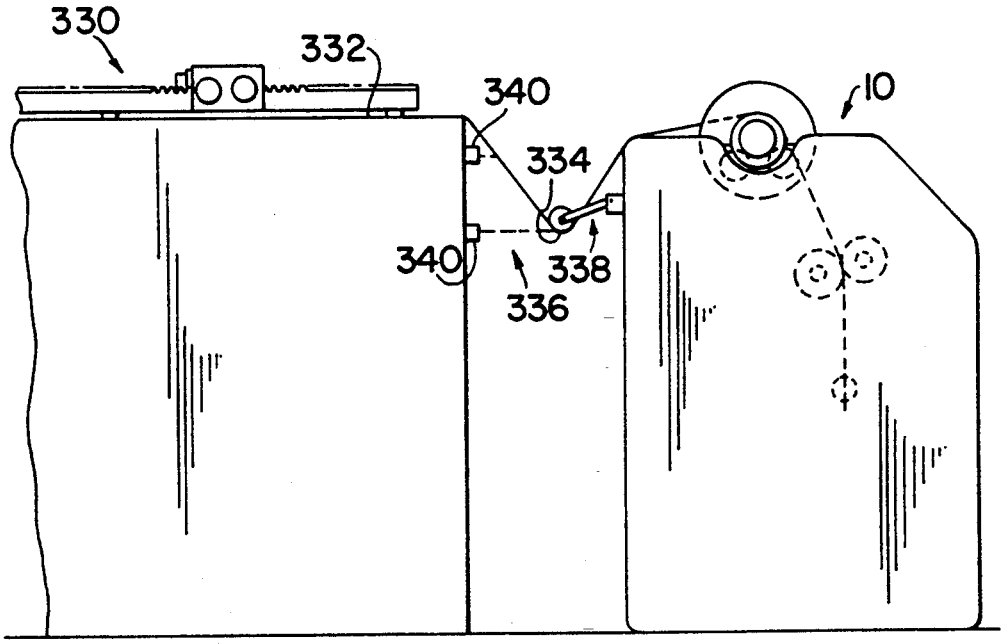

In FIGS. 15A and 15B, the winder is shown used in combination with a conventional plotter whereby it replaces the take-up roll normally located at the end of the plotter opposite the supply roll. The winder 10 in this case is positioned next to the plotter so as to orient the mandrel 34 generally parallel to the width of the sheet material being advanced. After being advanced off the support surface 332 of the plotter 330 by the plotter advancing means 331, the sheet material S is caused to follow a path over the mandrel 34 and may be constrained laterally against movement on it by the spools 40,40 which are adjustably clamped to accommodate the width of the sheet material presently being used. As shown in this embodiment, the controller 6 of the winder 10 and the control means of the plotter 330 are so linked to one another that the winder drive means 26 advances a sheet material off the support surface 32 at the same rate that the plotter advancing means 331 pulls the sheet material off the plotting surface 332.

In FIG. 15B, an alternative embodiment of the arrangement of FIG. 15A is shown. Here, the winder 10 is spaced from the take-off end of the plotter 330 such that the sheet material S in following the path leading it from the plotter and into the winder forms a loop 334 therebetween. A sensing means 336 is provided and is linked to the advancement means of both the plotter and the winder so as to maintain the loop 334 at a constant depth below the surface 332. The sensing means 336 in one embodiment may be a mechanical device taking the form of a dancer bar 338 vertically movable in response to the varying depths at which the bottom of the loop 334 may seek. The dancer bar cooperates with an upper and a lower limit switch to stop material advancement by the winder in response to the upper switch being activated and to stop material advancement at the plotter when the lower switch is activated. The sensing means 336 may alternatively take the form of optical sensors 340 which sense loop depth at critical points.

By the foregoing a winder embodying the present invention is disclosed. However numerous modifications and substitutions may be made without departing from the spirit of the invention. For example, the drive roller may be rotatably coupled to the input gear 45 by a slip clutch allowing the drive roller to mechanically vary its rotational speed from that which is being inputted to it by the drive motor 44 when the grippers rotate at a higher velocity than does the drive motor 44. Another example may be integrating the fingers 121,121 into each associated gripper assembly so that as the gripper pulls back, the involved finger pushes the tube R off the grippers.

Accordingly, the invention has been described by way of illustration rather than limitation.

I claim:

1. A winder for automatically winding sections of sheet material to form separate tubes, said winder comprising:

a base;

a means for supplying sheet material in web form;

a material drive means on said base for advancing said sheet material from said supply means towards a station on said base located remotely thereof;

winding means located at said station for winding a section of the sheet material about itself and about a rotational axis such that the section of sheet material is substantially wound in a tubular condition;

a cutting means located between said drive means and said rotational axis for cutting completely through the sheet material to form a leading free edge in the material extending generally transversely of its length at points therealong corresponding to the end of one section and the beginning of the next successive section of said web of sheet material;

said winding means including means for ripping marginal side edges of the web section to be wound adjacent said leading free edge thereof and for causing the section of web sheet material to be wound about itself as it is advanced from the supply means by said drive means and to be gripped and subsequently rotated about said rotational axis by said gripping means;

fastening means for applying a means to said tube created on said winding means to hold the sheet material in tubular form after the created tube is released from the winding means; and control means connected to said drive means and to said winding means to cause coordinated advancement of sheet material from said drive means to said winding means, said coordinated advancement including said drive means advancing said leading free edge of said sheet material to said winding means to enable winding of the next successive section of said sheet material about itself and about said rotatable axis, said control means further being connected to said cutting means and to said fastening means to cause cutting and fastening of the sheet material to be coordinated with its advancement.

2. A winder as defined in claim 1 further characterized in that said winding means includes a first and a second gripper each rotatable in unison about said axis of rotation and being so disposed on said base and slidable relative thereto as to be selectively engagable with a juxtaposed side edge of the sheet material.

3. A winder as defined in claim 2 further characterized in that each of said grippers has a given orientation and said winding means includes coupling means rotatably coupling said first and second grippers with one another such that the angular orientations of each of said first and second grippers are the same when so rotated taken relative to said given orientations.

4. A winder as defined in claim 3 further characterized in that said coupling means includes an elongate torque bar and a coupling box associating each of said first and second grippers and said torque bar;

said first and said second grippers being rotatably connected to one another through the intermediary of the torque bar extending generally transversely of the travel path followed by the sheet material through the winder.

5. A winder as defined in claim 4 further characterized in that at least one of said first and second grippers is adjustably mounted to the base and said coupling means allows the first and second grippers to be driven in rotation about said rotational axis while being adjustably positionable relative to one another on the base.

6. A winder as defined in claim 5 further characterized in that each of said first and second grippers is mounted to the base through the intermediary of a support plate;

each of said coupling boxes associating each of said first and second grippers and said torque bar being affixed to an associated one of the support plates and supporting the torque bar therebetween thus allowing rotation to be transferred from said torque bar to each of said first and second grippers through each of the coupling boxes.

7. A winder as defined in claim 6 further characterized in that said torque bar includes a key way formed along its length extending generally parallel thereto;

each of said coupling boxes includes a drive pulley and a driven pulley rotatably journalled therein;

the drive pulley associated with each coupling box having a central opening and a key projecting radially inwardly therefrom and engagable along the key way formed in the torque bar.

8. A winder as defined in claim 3 further characterized in that each of said first and second grippers is comprised of a pair of generally elongate engagement members pivotally mounted on a first actuator mounted for rotational movement on an associated shaft rotatable about said axis of rotation;

each of said engagement members having an arcuate outer surface and an inwardly disposed gripping face which is drawn into confrontation with the opposed gripping face associated with the other engagement member of each pair when the grippers are in a closed condition to define a gap therebetween.

9. A winder as defined in claim 8 further characterized in that each of said arcuate surfaces associated with each of the engaging members tapers radially inwardly from a point generally adjacent the first actuator toward the free ends thereof.

10. A winder as defined in claim 9 further characterized in that each of said gripping faces associated with each of said engagement members is defined by an insert which is detachably secured thereto.

11. A winder as defined in claim 8 further characterized in that each shaft associated with each of said first and second grippers is received within a second actuator for axial movement therein relative to said base in a direction parallel to said axis of rotation;

said sheet material being advanced having lateral side edges defining its width;

said second actuator means having means for rotatably journalling each shaft associated with said first and second grippers to said base such that the grippers are moveable between a first position wherein they are extended and positioned generally inwardly of the lateral side edges of the sheet material being advanced and a second position wherein they are retracted and are located at a distance therefrom.

12. A winder as defined in claim 11 further characterized in that said winding means includes a means for establishing a home position of each of said first and second grippers when said grippers are rotated;

said home position being such that the gap associated with each pair of engagement members is in coincident with the path of travel of the sheet material; and wherein said winding means further includes a stripper means for cooperating with the gap associated with each of said first and second grippers when said grippers are stopped at said home position to hold the tube of sheet material against movement when each of said first and second grippers are withdrawn from said first extended position by said second actuator means.

13. A winder as defined in claim 12 further characterized in that associated with each of said second actuators is a three position switch having a vent/pressure, pressure/vent, and vent/vent mode; and wherein each of said shafts associated-with said first and second grippers is axially biased away from one another along the rotational axis by a biasing means which acts to yieldably move the first and second grippers apart when the switch is in its vent/vent condition.

14. A winder as defined in claim 1 further characterized in that said drive means includes a drive roller rotatable in a direction about another axis of rotation;

said drive means further including a pinch roller supported for rotation on said base by a pair of holding arms capable of moving the pinch roller between a retracted and a extended position.

15. A winder as defined in claim 1 further characterized in that said fastening means includes a tape applicator in which is provided a supply of double sided adhesive;

said tape applicator having a contact roller and a slide actuator for moving the contact roller into and out of engagement with the sheet material such that when the roller is moved into engagement with the sheet material, the sheet material is held against an abutment surface mounted on the base to drive the contact roller in rotation when the sheet material is advanced.

16. A winder as defined in claim 15 further characterized in that said double-sided adhesive is carried on a base layer and is moved through said applicator through said frictional engagement with said contact roller;

said adhesive is comprised of a multiplicity of pads of adhesive material arranged in succession on said base layer;

said fastening means further includes a wrapper means having a leaf spring responsible for compressing the outer turn of sheet material onto the tube formed thereon; and wherein said leaf spring is caused to engage said tube through the intermediary of an actuator connecting it to said base such that said leaf spring extends generally tangentially towards the tube formed thereon.

17. A winder as defined in claim 1 further characterized in that said fastening means includes a glue applicator means disposed on one side of the sheet material for applying adhesive to one surface of said sheet material;

said glue applicator means including a glue stick and a stick advancement means for advancing the glue stick towards the sheet material; and wherein said glue applicator means further including a heating element disposed on the other side of the sheet material for melting the tip of the glue stick through the sheet material and onto it.

18. A winder as defined in claim 17 further characterized in that said stick advancing means includes a reciprocating actuator for advancing said glue stick toward said heating element incrementally as a result of the reciprocating motion generated by said actuator;

said fastening means further includes a wrapper means having a leaf spring responsible for compressing the outer turn of sheet material onto the tube formed thereon; and wherein said leaf spring is caused to engage said tube through the intermediary of an actuator connecting it to said base such that said leaf spring extends generally tangentially towards the tube formed thereon.

19. A winder as defined in claim 1 further characterized in that said fastening means includes an automatic stapler and a slide actuator mounting the automatic stapler for movement between an extended position wherein the stapler is in contact with the tube formed on the winding means and a retracted position wherein the stapler is out of engagement therewith;

said fastening means includes a wrapper means having a leaf spring responsible for compressing the outer turn of sheet material onto the tube formed thereon; and wherein said leaf spring is caused to engage said tube through the intermediary of an actuator connecting it to said base such that said leaf spring extends generally tangentially towards the tube formed on the first and second grippers.

20. A winder as defined in claim 1 further characterized in that said fastening means includes a clip dispenser and a slide actuator mounting said dispenser for movement relative to said support;

said dispenser having a supply of clips stacked side-by-side with one another and being urged into said dispenser;

said fastening means further includes a wrapper means having a leaf spring responsible for compressing the outer turn of sheet material onto the tube formed thereon;

said leaf spring is caused to engage said tube through the intermediary of an actuator connecting it to said base such that said leaf spring extends generally tangentially towards the tube formed thereon.

21. A winder as defined in claim 20 further characterized in that said dispenser is comprised of a base plate and a chambering mechanism formed thereon;

said chambering mechanism receiving for sliding engagement therewith Said shuttle member which causes each clip to be advanced from the chambering mechanism outwardly thereof and around the sheet material in tube form wound on said winding means.

22. A winder as defined in claim 21 further characterized in that said chambering means includes a ramping means for engaging with the leading end portions of each clip and spreading them outwardly thereof as the shuttle member drives the clip outwardly of the chambering means and causes the clip to be disposed about said tube in its expanded condition.

23. A winder as defined in claim 1 further characterized in that said fastening means is located intermediately of said gripping means and said drive means.

24. A winder as defined in claim 1 further characterized in that said fastening means and said gripping means are located generally coincidentally within a common horizontal plane which includes said rotational axis.

25. A winder as defined in claim 1 further characterized in that said base includes an edge alignment means having sensing means for detecting slewing of the side edge of a sheet material as it is advanced from said supply means to said station;

said alignment means further includes a first and a second sensor for determining right or left slewing of said sheet material; and wherein said first and second sensors are located side-by-side with one another to define a datum.

26. A winder as defined in claim 25 further characterized in that said alignment means includes a drive block rotatably supporting a pair of bearing rollers thereon;

said bearing rollers each having a width corresponding to that of an annular channel formed on a mandrel such that the mandrel is supported against the lateral movement by the bearing rollers received therein;

said drive block being capable of being controllably displaced laterally of the path travelled by said sheet material through said winder in response to said sensing means indicating the deviation from said datum point.

27. A winder as defined in claim 1 further characterized in that said means for supplying sheet material is part of a plotter having a control means adapted for use with the winder;

said winder and said plotter being so positioned relative to one another as to cause the sheet material moving off the plotter and through the winder to form a loop therebetween;

said control means further includes a first sensing means for sensing the depth of the loop at a first height and a second sensing means for sensing the depth of the loop at a second height lower than the first height; and wherein said second sensing means being connected to the control means of the plotter and causing it to stop advancement of the sheet material when the second sensor detects the presence of the bottom of the loop at the second height and said first sensor in detecting the presence of the bottom of the loop at the first height causes the control means to stop the advancement of sheet material by said drive means through said winder.

28. A winder as defined in claim 1 further characterized in that said cutting means includes a rotating circular serrated blade carried on a carriage travelling along a way disposed transversely to the advancing direction of the sheet material; and wherein said blade carriage has a throat means opening toward the path of travel of said sheet material such that it causes the paper to gradually be fed towards the blade.

29. A winder for automatically winding sections of sheet of material into a separate tubes, said winder comprising:

a base;

a means for supporting a supply of sheet material in roll from on said base for rotation about a first rotational axis;

a material drive means for advancing sheet material from the supply roll towards a station on said base located remotely thereof;

a winding means located at said station for winding a section of the sheet material about itself and about a second rotational axis such that the section of sheet material is substantially wound in a tubular condition;

a cutting means located between said first and said second rotational axes for cutting completely through the sheet material to form a leading free edge in the material extending generally transversely of its length at points therealong corresponding to the end of one section and the beginning of the next successive section;

said winding means including means for gripping marginal side edges of the web section to be wound adjacent said leading free edge thereof and for causing the section of web sheet material to be wound about itself as it is advanced from the supply means by said drive means and to be gripped and subsequently rotated about said rotational axis by said gripping means;

fastening means for applying a means to said tube created on said winding means to hold the sheet material in tubular form after the created tube is released from the winding means; and control means connected to said drive means and to said winding means to cause coordinated advancement of sheet material from said drive means to said winding means, said coordinated advancement including said drive means advancing said leading free edge of said sheet material to said winding means to enable winding of the next successive section of said sheet material about itself and about said rotational axis, said control means further being connected to said cutting means and to said fastening means to cause cutting and fastening of the sheet material to be coordinated with its advancement.

30. A winder as defined in claim 29 further characterized in that said support means for supporting a sheet of material on said winder includes an edge alignment means having means for detecting slewing of the side edge of a sheet material as it is advanced from said first rotational axis to said section station; and wherein said means for supporting a supply of sheet material includes a mandrel about which said supply of sheet material is wound in roll form, said mandrel having an annularly extending channel formed thereabout and being disposed at one end thereof.

31. A winder as defined in claim 30 further characterized in that said alignment means includes a drive block rotatably supporting a pair of bearing rollers thereon;

said bearing rollers each having a width corresponding to that of the annular channel formed on the mandrel such that the mandrel is supported against the lateral rotation by the bearing rollers received therein;

said drive block being ca able of being controllably displaced laterally of the path travelled by said sheet material through said winder in response to said sensing means indicating the deviation from an initial datum point.

32. A winder as defined in claim 29 further characterized in that said drive means includes a drive roller rotatable in a direction about axis of rotation parallel to each of said first and said second axes;

said drive means further including a pinch roller supported for rotation on said base by a pair of holding arms capable of moving the pinch roller between a retracted and a extended position.

33. A method for winding discrete sections of a continuous web of sheet material into separate tubes, said method comprising:

advancing said sheet material along a path of travel from a supply of such material to a station disposed remotely thereof;

providing means for winding a discrete length of sheet material bout itself and about a first axis of rotation and for allowing such winding of different discrete lengths of sheet material in this manner;

providing means for cutting said sheet material completely through to form a leading free edge in said sheet material;

providing said winding means with a means for gripping marginal side edges of a section of sheet material to be wound adjacent said leading free edge;

advancing a discrete length of said sheet material to said station and winding it about itself and about said first axis of rotation to form a tube of material by gripping the marginal side edges of the web section to be wound adjacent the leading free edge thereof and thereafter winding the web section about itself;

cutting said sheet material completely through to form a leading free edge extending generally transversely of its length at a point therealong separating the wound section from that which succeeds it and coinciding with the end of one discrete length and the beginning of another;

fastening the tube so that it remains held in a tubular form when it is released from the station; and releasing the tube rolled on said winding means and advancing the next section of sheet material to the station by advancing the leading free edge of the next discrete length of said sheet material to said winding means to enable winding and fastening of the next discrete length of sheet material into tube form in the same manner.

34. A method as defined in claim 33 further characterized by providing a drive means for advancing sheet material to said station and providing a gripper means for rotating the sheet material about said first axis;

gripping said sheet material with said gripping means and rotating it an initial increment while Said drive means remains in a non-rotated state;

advancing the sheet material using said drive means at a velocity greater than that of said gripper means to create a loop of material therebetween; and after said loop of material having a given length is created, causing said drive means and said gripper means to rotate in unison with one another at substantially the same relative velocities for a given number of rotations to form the core of a tube thereon.

35. A method as defined in claim 34 further characterized by ramping the rotational velocities of said drive means and said gripper means to maximum after said core is formed and driving said gripper means at a slightly greater velocity than that of said drive means when the sheet material is driven at the system maximum velocity.

36. A method as defined in claim 35 further characterized by providing as part of said drive means a drive roller and a pinch roller and mounting said pinch roller relative to said drive roller such that it is capable of being selectively moved into and out of engagement with said drive roller; and causing said pinch roller to be intermittently disengaged with said drive roller when sheet material is being advanced at the system maximum velocity.

37. A method as defined in claim 34 further characterized by providing indicia on the sheet material representing the separation point between successive sections of the sheet material;

providing a means for sensing said indicia as the sheet material is advanced by the drive means;

using said sensing means to identify the presence of indicia at a given Point along the travel path of the sheet material;

and causing said sheet material to be advanced to said station at a creep velocity once the indicia is detected.

38. A method as defined in claim 37 further characterized by said advancement of said sheet material at a creep velocity being stopped after the indicia travels a predetermined distance from the point when it was first detected.

39. A method as defined in claim 38 further characterized by said drive means being braked while said gripper means is slightly rotated to tighten the tube of sheet material after its advancement at creep velocity is ceased.

40. A method as defined in claim 39 further characterized by providing an adhesive applicator and moving it into engagement with said sheet material after said gripper means causes the tube to be tightened, and advancing the sheet material slightly to deposit adhesive through the intermediary of the applicator brought into engagement with it, and retracting the applicator and cutting the sheet material transversely of its length just above the applied adhesive.

41. A method as defined in claim 39 further characterized by Cutting said sheet material transversely of its length after the tube of sheet material on the gripping means has been tightened, and thereafter applying a holding means to the tube to secure it against unravelling.

42. A method as defined in claim 33 further characterized in that said tube is held by opposed grippers which rotate it about the first rotational axis;

moving the opposed grippers transversely of the travel path of the sheet material to cause winding of the sheet material into a tubular form; and causing the opposed grippers to move away from one another to release the tube of material from the grippers.

43. A method as defined in claim 33 further characterized by carrying out said winding of the sheet material in stand alone winder;

juxtaposing said winder adjacent to the take-up end of a plotter, and feeding sheet material from off the plotter and into the winder as the plotter conducts a series of plotting operations thereon.

44. A method as defined in claim 43 further characterized by feeding sheet material from the plotter to the winder such that it forms a loop therebetween;

maintaining the loop at a constant length to insure uniform advancement of sheet material off the plotter and into the winder by stopping advancement of the sheet material at said winder when said loop depth is at a first level and stopping advancement of said sheet material at said plotter when said loop depth is at a second level lower than said first level.

45. A winder for automatically winding sections of sheet material to form separate tubes, said winder comprising;

a base;

a means for supplying sheet material;

a material drive means on said base for advancing sheet material from said supply means towards a station on said base located remotely thereof;

a winding means located at said station for winding a section of the sheet material about itself and about a rotational axis such that the section of sheet material is substantially wound in a tubular condition;

a cutting means located between said drive means and said rotational axis for cutting the sheet material completely through transversely of its length to form a leading free edge at points therealong corresponding to the end of one section and the beginning of the next successive section of sheet material to be advanced to said station;

said winding means including means for gripping marginal side edges of the web section to be wound adjacent said leading free edge thereof and for causing the section of web sheet material to be wound about itself as it is advanced from the supply means by said drive means and to be gripped and subsequently rotated about said rotational axis by said gripping means;

fastening means for applying a means to said tube created on said winding means to hold the sheet material in tubular form after the created tube is released from the winding means; and control means connected to said drive means and to said winding means to cause coordinated advancement of sheet material from said drive means to said winding means such that said drive means and said winding means are capable of winding sections of said sheet material of different lengths into tubes, said control means further being connected to said cutting means and to said fastening means to cause cutting and fastening of the sheet material to be coordinated with its advancement;

means for applying a means to said tube created on said winding means to hold the sheet material in tubular form after the created tube is released from its holding engagement with the winding means; and control means connected to said drive means and to said winding means to cause coordinated advancement of sheet material from said drive means to said winding means, said control means further being connected to said cutting means and to said fastening means to cause cutting and fastening of the sheet material to be coordinated with its advancement.

* * * * *